US005626719A

United States Patent [19]

Tansley et al.

[11] Patent Number: 5,626,719

[45] Date of Patent: May 6, 1997

[54] SYSTEM FOR SIZING PAPER AND CARDBOARD

[75] Inventors: Anthony C. Tansley, Amersfoort, Netherlands; John D. Ballantine, Ilford, United Kingdom

[73] Assignee: Hercules Incorporated, Wilmington, Del.

[21] Appl. No.: 478,628

[22] Filed: Jun. 7, 1995

Related U.S. Application Data

[62] Division of Ser. No. 94,273, Jul. 19, 1993, Pat. No. 5,456,800.

[30] Foreign Application Priority Data

Jul. 21, 1992 [GB] United Kingdom ..... 9215422

[51] Int. Cl.[6] ..... D21H 21/16

[52] U.S. Cl. ..... 162/158; 162/164.3; 162/164.6; 162/172; 162/179; 162/194; 162/196; 162/201; 162/231; 53/425; 53/426; 206/524.3; 206/524.6; 229/902; 493/51; 493/53; 493/148; 493/162; 493/340; 493/467

[58] Field of Search ..... 162/158, 164.3, 162/164.6, 172, 179, 183, 243, 211, 171, 194, 196, 201, 231, 100, 161; 206/524.3, 524.6; 53/425, 426; 229/902; 493/211, 220, 328, 330, 339, 340, 467, 480, 51, 53, 148, 162; 422/28

[56] References Cited

U.S. PATENT DOCUMENTS

| | | | |
|---|---|---|---|
| 3,922,243 | 11/1975 | Aldrich | 260/29.2 N |
| 4,017,431 | 4/1977 | Aldrich | 260/18 R |
| 4,522,686 | 6/1985 | Dumas | 162/158 |
| 4,859,244 | 8/1989 | Floyd | 106/243 |
| 4,919,724 | 4/1990 | Cenisio et al. | 162/158 |
| 4,927,496 | 5/1990 | Walkden | 162/158 |
| 5,032,226 | 7/1991 | Winiker | 162/179 |
| 5,190,584 | 3/1993 | Ruffini | 162/179 |

FOREIGN PATENT DOCUMENTS

| | | | |
|---|---|---|---|
| 0268751 | 8/1987 | European Pat. Off. | G03C 1/87 |
| 58087395 | 5/1958 | Japan . | |
| 1402196 | 8/1975 | United Kingdom . | |
| 2107610 | 5/1983 | United Kingdom | G03C 1/87 |

OTHER PUBLICATIONS

Translation of JP87395/58:1983 (Tokkai) mentioned above.

*Primary Examiner*—Peter Chin
*Attorney, Agent, or Firm*—Ivan G. Szanto

[57] ABSTRACT

A process for increasing the resistance of the cut edges of liquid packaging board to penetration by hot hydrogen peroxide, comprising adding to an aqueous pulp slurry at a neutral to alkaline pH, either separately or in preblended form an aqueous emulsion of a cellulose-reactive size, a non-cellulose-reactive size selected from the group consisting of waxes, bis-stearamides, and fatty acid derivatives, and a thermosetting resin that is capable of covalent bonding to cellulose fibre and self-cross-linking.

5 Claims, No Drawings

SYSTEM FOR SIZING PAPER AND CARDBOARD

This application is a division, of application Ser. No. 08/094,273, filed Jul. 19, 1993 now U.S. Pat. No. 5,456,800.

This invention relates to a process for sizing paper pulp intended especially for use in producing liquid packaging board, particularly packaging board having good resistance to hot penetrants.

BACKGROUND OF THE INVENTION

Containers for packaging liquid products, particularly dairy products such as milk and cream, are made out of coated paper-based board. The coating may be on one side of the board but is generally on both sides and is usually polyethylene, although other water-proofing substances may be used.

To function effectively in such a container, the board must be resistant to the effects of the liquid. For liquid dairy products the most aggressive penetrating component of the liquid is generally lactic acid. The most vulnerable part of the board tends to be its cut edge.

Board manufacturers have therefore investigated ways to improve the resistance of board to edge penetration by lactic acid-containing liquids. It is known that board sized with a ketena dimer (KD) has good resistance to edge penetration by lactic acid-containing liquids.

The demand for the aseptic packaging of liquids, in particular for liquid dairy products, makes it necessary to sterilize the package as well as its contents. Containers made out of board are usually sterilized by contact with hydrogen peroxide solutions at elevated temperatures (for instance, at about 70° C.). Unfortunately board sized with a KD has low resistance to edge penetration by hot hydrogen peroxide-containing solutions, and of course sizing with a cellulose-reactive size like KD has the inherent economic disadvantage that it does not take place "on-machine"; in other words, it requires an aging period for the sizing to be fully effective.

It is known that board sized with a cationic resin size (CRS) or with a conventional anionic resin size (emulsion, pasta or soap) has good resistance to edge penetration by hot hydrogen peroxide-containing liquids, but low resistance to edge penetration by lactic acid-containing liquids. There has also been a trend to make board from secondary fibre under neutral rather than acid conditions. This avoids some of the problems associated with recycled chalk fillers, and it is well known that sizing with KD's must be carried out at neutral or slightly alkaline pH's (between 7 and 8.5) in order to achieve effective sizing, while sizing paper with rosin must be carried out at pH's below 5.

U.S. Pat. No. 4,859,244 of International Paper Company discloses paper sizing agents composed of blends of fatty acid anhydrides and alkyl ketene dimers, that improve resistance to wicking on paperboard containers.

British Patent Specification 1,402,196 discloses aqueous dispersions of wax using fused or dissolved waxes and a thermosettable cationic resin as a dispersing agent, for use in sizing paper.

U.S. Pat. No. 3,922,243 of Hercules Incorporated discloses paper sizing agents composed of aqueous suspensions or dispersions of wax blends for use in the sizing of paper and containing from 99% to 93% of either a petroleum wax or a synthetic hydrocarbon wax and from 1% to about 7% of a $C_{12}$ to $C_{24}$ saturated fatty acid, or a blend containing from about 99.5% to about 75% of a petroleum wax or a synthetic hydrocarbon wax and from 0.5% to about 25% of an alkyl ketene dimer, or a mixture of the two kinds of blends. The sizing effect is measured by a surface sizing test, and the problems of edge penetration by lactic acid and hot hydrogen peroxide in the manufacture of liquid packaging board are not addressed.

None of the above references suggest the problem caused by sterilization by hydrogen peroxide, nor is there any indication that the sizing agents disclosed would have any effect on resistance to edge penetration by hydrogen peroxide-containing liquids nor by liquids containing lactic acid following contact with hot hydrogen peroxide solutions.

U.S. Pat. No. 4,927,496 to Hercules Incorporated addresses the problems of the penetration by hot hydrogen peroxide at the cut edge of liquid packaging board by the use of mixtures of a cellulose-reactive sizing agent (an alkyl ketene dimer emulsified with a cationic starch derivative), and a cationic rosin size mixture containing a fortified rosin, an insolubilizing agent, and a polyamide cationic resin as a conventional dispersing agent for the rosin. It does not disclose the use of combinations of ketene dimer and other sizing agents that do not contain a CRS size, as a solution to edge penetration by hot hydrogen peroxide.

There is therefore a need for method of producing a packaging board that has good resistance to edge penetration by both lactic acid and hot peroxide-containing liquids, and that provides sizing while the board is still on the paper machine, and therefore avoid traditional CRS sizes with insolubilizing agents.

SUMMARY OF THE INVENTION

According to the invention a process for increasing the resistance of the cut edges of liquid packaging board to penetration by hot hydrogen peroxide comprises adding to an aqueous pulp slurry at a neutral to alkaline pH, a cellulose-reactive size, a thermosetting resin that is capable of covalent bonding to cellulose fibre and self-cross-linking, and a non-cellulose-reactive size selected from the group consisting of waxes, bis-stearamides, and fatty acid derivatives.

Preferably the cellulose-reactive size and the non-cellulose-reactive size are dispersed in water before being added to the pulp slurry, and more preferably they are melted and blended together and then made into an aqueous dispersion before the addition.

Preferably, the cellulose-reactive size is an alkyl ketane dimer, and the non-cellulose-reactive size is selected from the group consisting of bis-stearamides and fatty acid esters.

Preferably, the non-reactive size should have a melting point above the elevated temperatures, conventionally about 70° C., of the sterilizing hydrogen peroxide solution.

Preferably, the thermosetting resin is selected from the group consisting of the reaction products of spichlorohydrin with polyaminoamide, the polyaminoamide being derived by reaction of a dicarboxylic acid and a polyalkylene-amine; the reaction products of epichlorohydrin with a polyalkyleneamine; and the reaction products of epichlorohydrin with poly (diallylamine).

Also, according to the invention, a process for making a sizing emulsion comprises melting and blending together a cellulose-reactive size and a non-cellulose-reactive size and dispersing the blend in an aqueous solution of a thermosetting resin.

The invention also includes a sizing emulsion made according to the process according to the invention.

The invention also includes a process for making a container for consumable liquids that comprises the steps of forming an aqueous pulp slurry at neutral to alkaline pH, adding to the pulp a thermosetting resin, a cellulose-reactive size, and a non-cellulose-reactive size selected from the group consisting of waxes, bis-stearamides, and fatty acid derivatives, forming paperboard from an aqueous pulp slurry at neutral to alkaline pH, cutting the board to packaging size and thereby exposing cut edges of the board, coating the board with a water-proofing substance, treating it with a hot aqueous solution of hydrogen peroxide, and forming a packaging unit from the board.

The invention also includes a process for making a container for consumable liquids that comprises the steps of forming an aqueous pulp slurry at neutral to alkaline pH, adding to the pulp an aqueous solution of a thermosetting resin and an aqueous dispersion of a cellulose-reactive size and an aqueous dispersion of a non-cellulose-reactive size selected from the group consisting of waxes, bis-stearamides, and fatty acid derivatives, forming paperboard from an aqueous pulp slurry at neutral to alkaline pH, cutting the board to packaging size and thereby exposing cut edges of the board, coating the board with polyethylene, treating it with a hot aqueous solution of hydrogen peroxide, and forming a packaging unit from the board.

The invention also includes a container for consumable liquids made by the process according to the invention.

The said container for consumable liquids has unexpectedly high resistance to hot penetrants, especially resistance to edge penetration of paper and paperboard by hot hydrogen peroxide-solution, as well as a surprisingly reduced edge penetration of lactic acid solution, without requiring an insolubilizing agent.

Although the pulp produced by the process according to the invention for increasing the resistance of the cut edges of liquid packaging board to penetration by hot hydrogen peroxide conventionally is formed into paperboard for use in the aseptic packaging of foods that requires resistance to hot penetrants, the invention is not of course limited to such use and the pulp may be formed into other products that benefit from its characteristics.

DETAILED DESCRIPTION OF THE INVENTION

The thermosetting resin that may be usefully employed in this invention, which are capable of covalent bonding to cellulose fibre and self-cross-linking are normally cationic and are reactive under conventional paper-making conditions of pH, temperature, and moisture. Among the preferred thermosetting resins as indicated above, the reaction products of epichlorohydrin with poly (diallylamine), especially include the poly (N-alkyldiallylamines).

More preferred thermosetting resins are the reaction products of epichlorohydrin with polyaminoamide where the polyaminoamide is derived by reaction of a dicarboxylic acid and a polyalkyleneamine; the reaction products of epichlorohydrin with a polyalkyleneamine; and the reaction products of epichlorohydrin with poly (diallylamine), especially a poly (N-alkyldiallylamine).

The more preferred thermosetting resins are the products of the reaction of epichlorohydrin with polyaminoamides, most preferably those polyaminoamides derived by reacting adipic acid with diethylenetriamine. Examples of preferred resins are available from Hercules Incorporated under the registered trade mark KYMENK® as Kymene 557H, Kymene 367 and Kymene 260.

The thermosetting resins are prepared conventionally in aqueous solutions. The reactive sizes and non-reactive sizes are hydrophobic solids that are normally made into stable dispersions in water prior to use in the paper making process. Any conventional cationic, anionic or non-ionic dispersing agents and stabilizers such as sodium lignosulphonate, starch, cationic starch, anionic starch, amphoteric starch, water-soluble cellulose ethers, polyacrylamides, polyvinyl alcohol, polyvinyl pyrrolidone, polyamides etc., or mixtures thereof, may be used to make these stable dispersions in water. Any conventional mechanical process may be used in the preparation of these dispersions.

The preparation of stable dispersions of reactive and non-reactive sizes, including the choice of conventional stabilizers and dispersing agents, falls within the competence of those skilled in the art. The preferred stabilizer is a cationic starch and the preferred dispersing agent is sodium lignosulphonate.

Any conventional cellulose-reactive paper sizing agent, including, for example, alkenyl succinic anhydride, as well as ketene dimers, may be usefully employed in this invention. The preferred alkyl ketene dimers used as sizing agents according to the invention, are dimers having the formula:

$$(R{-}CH{=}C{=}O)_2$$

wherein R is an alkyl radical, which may be saturated or unsaturated, having from 6 to 24 carbon atoms, preferably more than 10 carbon atoms and most preferably from 14 to 16 carbon atoms; a cycloalkyl radical having at least 6 carbon atoms, or a comparable aryl, aralkyl or alkaryl radical. These KD's are well known, for instance from U.S. Pat. No. 2,785,067, the disclosure of which is incorporated herein by reference.

Suitable KD's include decyl, dodecyl, tetradecyl, hexadecyl, octadecyl, aicosyl, docosyl, tetracosyl cyclohexyl, phenyl, benzyl and naphthyl ketene dimers, as well as KD's prepared from palmitoleic acid, oleic acid, ricinoleic acid, lincleic acid, myristoleic acid and eleostearic acid. The KD may be a single species or may contain a mixture of species.

The most preferred ketene dimers are alkyl ketene dimers prepared from C14–C22 linear saturated natural fatty acids.

Any non-reactive size from the general classes of waxes, bis-stearamide, rosin derivatives and fatty acid derivatives may be usefully employed in this invention. The preferred non-reactive sizes are bis-stearamide and fatty acid esters. The most preferred non-reactive sizes are fatty acid esters, especially glycerol triesters of natural fatty acids (glycerides), having softening points above the temperature of the hydrogen peroxide sterilizing solution). If the non-cellulose-reactive size is a wax, it is preferably in the form of an aqueous dispersion of a fused wax or a wax solution blended with an amino polyamide-epichlorohydrin resin, as disclosed in British Patent Specification 1,402,196, the disclosure of which is incorporated herein by reference.

The dispersions of the present invention may include also other additives used commercially in the art of paper making such as promoter resins for ketene dimers, biocides etc. The actual amount of solids present in these dispersions may vary from 3 to about 50% by weight, preferably from about 4 to 40% and most preferably from about 5 to 35%.

The dispersion of the reactive size, the dispersion of the non-reactive size and the solution of the thermosetting resin may be added separately to the paper making stock at any convenient points in the paper machine systems. It would normally be advantageous to add these chemicals to the paper stock just prior to the formation of the paper sheet. It is necessary to ensure that all three chemicals mix thoroughly with the paper stock before sheet formation.

The two size dispersions may be premixed before addition to the paper stock, or they may be dispersed separately in solutions of the thermosetting resin, and these may be added to the paper stock separately or premixed before addition.

A process for making a premixed sizing emulsion according to the invention also comprises melting and blending together a cellulose-reactive size and a non-cellulose-reactive size and dispersing the blend in an aqueous solution of a thermosetting resin.

Preferably the cellulose-reactive size is present in an amount of from about 0.01 to about 0.48 percent based on the dry weight of the pulp, and the non-cellulose-reactive size is present in an amount of from about 0.01 to about 2.0 percent based on the dry weight of the pulp.

More preferably the amount of reactive size added to the paper stock is from 0.02 to 0.24 percent, and most preferably from 0.03 to 0.12 percent.

More preferably the amount of non-reactive size added to the paper stock is from 0.06 to 1.2 percent, and most preferably from 0.12 to 0.60 percent.

The amount of thermosetting resin added to the paper stock is from 0.03 to 0.60 percent, more preferably from 0.04 to 0.48 percent, and most preferably from 0.1 to 0.36 percent.

All these percentages are on a dry basis (db), which is the dry weight of chemical based on the dry weight of paper.

The following examples illustrate the invention. All parts and percentages are by weight unless otherwise specified.

EXAMPLES

Test paper (160 g/m) was prepared using a pilot paper machine, the sizing additives being added separately but simultaneously. The sizing additives were added as starch stabilized dispersions and the thermosetting resins as aqueous solutions.

A stock that is relatively difficult to size was chosen, comprising 25% hardwood (bleached birch sulphate) 25% softwood (bleached pine sulphate) and 50% bleached CTMP, representing current commercial practice.

The degree of sizing was measured by a 1 minute Cobb test, a hot water test and/or an edge penetration test. The Cobb test using water is an internationally recognized test. The "hot water test" is carried out by floating a "boot" of the test paper, wire side in contact with the water at 60° C. Results are quoted for the time in seconds to see penestration by first drop or for the percentage of surface wet after 600 seconds. Edge penetration is determined by coating each side of paper samples (60×40 mm cut in both MD and CD directions) with a water resistant barrier, weighing and immersing the samples in the penetrant to a depth of 10 mm (5–20 mm) and then blotting and reweighing the samples after a given time.

For lactic acid edge penetration determinations a 1% lactic acid solution is used as the penetrant and the samples left immersed for 24 hours before testing. For paroxide the samples are immersed in 30% hydrogen peroxide solution at 70° C. for 10 minutes.

EXAMPLE 1

Example 1 illustrates the beneficial effect of cationic resins on sizing against hot penetrants when used in conjunction with a reactive size or a reactive/non-reactive combination. Lactic acid resistance is also improved.

| SIZING SYSTEMS | | | EDGE PENETRATION TEST | | HOT WATER | COBB |
|---|---|---|---|---|---|---|
| Reactive Size (0.12% db) | Non-Reactive Size (0.24% db) | Thermosetting Resin (0.16% db) | Hydrogen peroxide ($g/m^2$) | Lactic acid ($g/m^2$) | TEST (secs) | TEST $g/m^2$ |
| KD | — | — | 4.2 | 1.8 | RP* | 20.3 |
| — | NR1 | — | 8.9 | 4.6 | " | 45.0 |
| — | Bis-stearamide | ✓ | 8.4 | 4.2 | " | RP* |
| — | — | — | 3.6 | 2.8 | " | " |
| KD | NR1 | — | 7.3 | 2.2 | 18 | |
| KD | Bis-stearamide | — | 6.8 | 1.6 | 13 | |
| KD | — | ✓ | 3.5 | 2.9 | 38 | |
| — | NR1 | ✓ | 3.6 | 2.5 | RP* | |
| — | Bis-stearamide | ✓ | 3.0 | 2.4 | " | |
| KD | NR1 | ✓ | 2.1 | 0.5 | 9 | 17.0 |
| KD | Bis-stearamide | ✓ | 2.2 | 1.1 | 33 | 19.8 |

*RP = Rapid Penetration

EXAMPLE 2

Example 2 illustrates that a thereosettable cationic resin is necessary to obtain improvement in peroxide "edgewick".

| Sizing Systems | | Edge Penetration Test | | |
|---|---|---|---|---|
| Reactive Size (0.12% db) | Cationic Resin (0.24% db) | Hydrogen peroxide ($g/m^2$) | Lactic acid ($g/m^2$) | Cobb Test $g/m^2$ |
| KD | Cationic starch** | 2.7 | 1.0 | 21.2 |
| — | Cationic starch | 7.3 | 4.3 | P* |
| KD | Polyamine-epi | 1.5 | 0.7 | 19.6 |
| — | resin | 3.1 | 2.3 | P* |
| KD | Polyallyl-epi | 1.2 | 0.7 | 19.9 |
| KD | resin | 2.9 | 2.2 | P* |
| KD | Polyamide-epi | 1.6 | 0.8 | 19.2 |
| — | resin (low molecular wt.) | 2.8 | 2.0 | P* |
| KD | Polyamide-epi | 1.3 | 0.6 | 19.3 |
| — | resin (high molecular wt.) | 2.9 | 2.4 | P* |
| KD | Dicyandiamide- | 3.3 | 2.2 | 21.8 |

-continued

| Sizing Systems | | Edge Penetration Test | | |
|---|---|---|---|---|
| Reactive Size (0.12% db) | Cationic Resin (0.24% db) | Hydrogen peroxide ($g/m^2$) | Lactic acid ($g/m^2$) | Cobb Test $g/m^2$ |
| — | formaldehyde resin** | 7.4 | 3.99 | P* |
| KD | Polyethylene | 4.1 | 0.9 | 23.3 |
| — | imine** | 7.3 | 3.1 | P* |

*P = Penetration
** — = Non-thermosetting resins

EXAMPLE 3

Table 1 and Table 2 of Example 3 that follow illustrate the beneficial effect of non-reactive sizes on lactic acid edgewick resistance and the beneficial effect of higher melting point non-reactive sizes on hot hydrogen peroxide edge penetration. The KD size is alkyl ketene dimer prepared from mixed C16/C18 fatty acids. The thermosetting resin is an epichlorohydrin adduct of a polyaminoamide.

TABLE 1

| SIZING SYSTEMS | | | EDGE PENETRATION | |
|---|---|---|---|---|
| Reactive Size (0.06% db) | Non-Reactive Size (0.54% db) | Thermo-setting Resin (0.2% db) | Hydrogen Peroxide ($g/m^2$) | Lactic Acid ($g/m^2$) |
| KD | — | — | 4.2 | 1.9 |
| KD | — | ✓ | 3.7 | 2.4 |
| KD | $NR^1$* | ✓ | 3.7 | 0.6 |
| KD | $NR^2$* | ✓ | 2.9 | 0.6 |
| | | | | Softening Point |
| *$NR^1$ | Glycerol triester of mixed C16–C18 fatty acid | | | 55° C. |
| *$NR^2$ | Glycerol triester of C22 fatty acid | | | 80° C. |

TABLE 2

| Sizing System | | Hot Water Test (Penetration | Cobb |
|---|---|---|---|
| Reactive Size (0.05% db) | Non-Reactive Size (0.25% db) | after 600 secs) (%) | Test ($g/m^2$) |
| KD | $NR^1$* | 80 | 23 |
| KD | $NR^2$* | 0 | 26 |
| KD | $NR^3$* | 78 | 25 |
| KD | $NR^4$* | 60 | 36 |

TABLE 2-continued

| | | | |
|---|---|---|---|
| KD | — | 0 | 23 |
| | | | Softening Point |
| *$NR^1$ | Glycerol triester of mixed C16–C18 fatty acid | | 55° C. |
| *$NR^2$ | Glycerol triester of C22 fatty acid | | 80° C. |
| *$NR^3$ | Glycerol triester of C18 fatty acid | | 65° C. |
| *$NR^4$ | Hydrogenated Castor Oil | | 85° C. |

We claim:

1. A process for making a container for consumable liquids that comprises the steps of forming an aqueous pulp slurry at neutral to alkaline pH, adding to the pulp a thermosetting resin, a cellulose-reactive size, and a non-cellulose-reactive size selected from the group consisting of bis-stearamides and glycerol triesters of natural fatty acids, wherein the cellulose reactive size is present in an amount of from about 0.01 to about 0.48 percent, the non-cellulose reactive size is present in the amount of from about 0.01 to about 2.0 percent and the thermosetting resin is present in an amount of from about 0.03 to about 0.60 percent, all based on the dry weight of the pulp, forming paperboard from an aqueous pulp slurry at neutral to alkaline pH, cutting the board to packaging size and thereby exposing cut edges of the board, coating the board with a water-proofing substance, treating it with a hot aqueous solution of hydrogen peroxide, and forming a packaging unit from the board.

2. A process for making a container for consumable liquids as claimed in claim 1 wherein said thermosetting resin is added as an aqueous solution and said cellulose-reactive size and said non-cellulose reactive size are added as aqueous dispersions and wherein said water-proofing substance is polyethylene.

3. The process of claim 1 for making a container for consumable liquids wherein said reactive sizing agent and nonreactive sizing agent are melted and blended together and said blend is dispersed in an aqueous solution of said thermosetting resin to form a sizing emulsion and adding said sizing emulsion to said aqueous pulp slurry, forming paperboard from the aqueous pulp slurry at neutral to alkaline pH, cutting the board to packaging size and thereby exposing cut edges of the board, coating the board with a water proofing substance wherein said water proofing substance is polyethylene, treating it with a hot aqueous solution of hydrogen peroxide, and forming a packaging unit from the board.

4. A container for consumable liquids made by the process as claimed in claim 1.

5. A container for consumable liquids made by the process as claimed in claim 2.

* * * * *

UNITED STATES PATENT AND TRADEMARK OFFICE

CERTIFICATE OF CORRECTION

PATENT NO. : 5,626,719

DATED : May 6, 1997

INVENTOR(S) : Anthony C. Tansley and John D. Ballantine

It is certified that error appears in the above-indentified patent and that said Letters Patent is hereby corrected as shown below:

Column 2, line 57 of the printed patent, "spichlorohydrin" should read -- epichlorohydrin --.

Column 4, line 1 of the printed patent, "KYMENK®" should read -- KYMENE®--.

Column 6, line 2 of the printed patent, "boot" should read--boat --.

Column 6, line 15 of the printed patent, "paroxide" should read -- peroxide --.

Example 1, under "Thermosetting Resin," "(0.16% db)" should read -- (0.36% db) --.

Example 1, under "Lactic acid ($g/m^2$)", "1.8" should read -- 1.9 --.

Signed and Sealed this

Fifth Day of May, 1998

Bruce Lehman

*Attest:*

BRUCE LEHMAN

*Attesting Officer*

*Commissioner of Patents and Trademarks*